US005251581A

United States Patent [19]

Takahashi et al.

[11] Patent Number: 5,251,581

[45] Date of Patent: Oct. 12, 1993

[54] TWO CYCLE ENGINE PROVIDED WITH A SCAVENGING PUMP

[75] Inventors: Masanori Takahashi; Masahiko Kotoh, both of Hamamatsu, Japan

[73] Assignee: Sanshin Kogsyo Kabushuki Kaisha, Hamamatsu, Japan

[21] Appl. No.: 872,183

[22] Filed: Apr. 22, 1992

[30] Foreign Application Priority Data

Apr. 23, 1991 [JP] Japan ..... 3-116595

[51] Int. Cl.[5] ..... F02B 25/16; F02B 33/34; F02F 1/22

[52] U.S. Cl. ..... 123/65 P; 123/73 PP; 123/65 BA

[58] Field of Search ..... 123/65 PE, 65 P, 73 PP, 123/65 VC, 65 BA, 65 R

[56] References Cited

U.S. PATENT DOCUMENTS

| | | | |
|---|---|---|---|
| 2,367,565 | 1/1945 | Curtis | 123/65 VC |
| 2,645,214 | 7/1953 | Birnstiel | 123/65 VC |
| 2,744,506 | 5/1956 | Reynolds | 123/65 VC |
| 2,787,987 | 4/1957 | Portmann | 123/65 VC |
| 2,820,339 | 1/1958 | Grieshaber et al. | 123/65 VC |
| 2,887,993 | 5/1959 | Shallenberg | 123/65 BA |
| 3,077,189 | 2/1963 | Earnshaw et al. | 123/65 BA |
| 4,254,752 | 3/1981 | Friddell et al. | 123/65 BA |

FOREIGN PATENT DOCUMENTS

| | | | |
|---|---|---|---|
| 842238 | 6/1952 | Fed. Rep. of Germany | 123/65 VC |
| 2-76126 | 6/1990 | Japan . | |

*Primary Examiner*—David A. Okonsky
*Attorney, Agent, or Firm*—Ernest A. Beutler

[57] ABSTRACT

An improved scavenging system for a two cycle internal combustion engine wherein the cylinder block of the engine is provided with an internal plenum chamber that surrounds the lower portion of the cylinders and which supplies the scavenge ports of the engine. In this way, it will be ensured that the proper air flow can issue from each scavenge port.

16 Claims, 3 Drawing Sheets

TWO CYCLE ENGINE PROVIDED WITH A SCAVENGING PUMP

BACKGROUND OF THE INVENTION

This invention relates to a two cycle engine provided with a scavenging pump and more particularly to an improved scavenging system for a two cycle engine.

In order to improve the scavenging and performance of a two cycle engine, it has been proposed to provide a plurality of scavenge ports for each cylinder. These scavenge ports and the scavenge passages which serve them are oriented in such a way so as to achieve the desired scavenging pattern in the engine. Conventionally, it has been the practice to provide a scavenge manifold around the cylinder and from which the scavenge passages extend to serve their respective scavenge ports. A disadvantage with the prior art type of constructions is that the scavenge manifold, being cast or formed integrally within the cylinder block, has a relatively small effective cross-sectional area. Because of this, the air flow to the individual scavenge passages may not be as desired. That is, those scavenge passages which are closest to the air inlet will receive full air flow while those positioned more remotely will have their flow deteriorated due to the restriction of the scavenge manifold.

It is, therefore, a principal object of this invention to provide an improved scavenging arrangement for a two cycle internal combustion engine.

It is a further object of this invention to provide a scavenging system for a two cycle internal combustion engine wherein adequate air flow to all scavenge passages can be accomplished.

It is a further object of this invention to provide a plenum chamber within the cylinder block from which the scavenge passages are all served so as to ensure that the air flow to the individual scavenge passages will not be deteriorated by the flow to other scavenge passages.

SUMMARY OF THE INVENTION

This invention is adapted to be embodied in an internal combustion engine that is comprised of a cylinder block forming at least one internal cylinder having a cylinder bore. The cylinder block is formed with an internal plenum chamber that surrounds the cylinder. At least a pair of scavenge ports extend through the cylinder for admitting a charge thereto and at least a pair of scavenge passages each extend from the plenum chamber to a respective one of the scavenge ports for delivering air thereto.

DETAILED DESCRIPTION OF THE PREFERRED EMBODIMENT OF THE INVENTION

Figure 1:
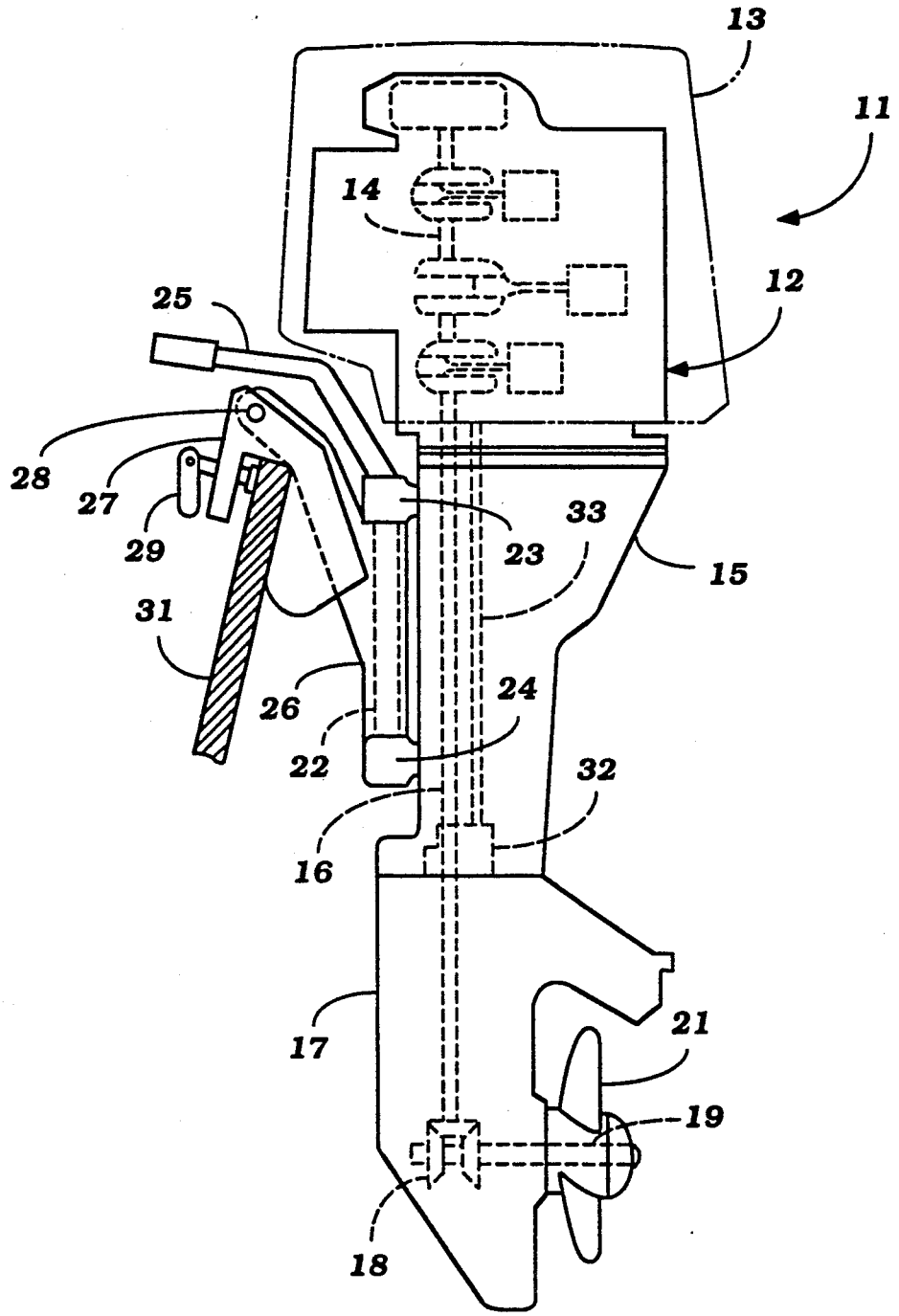
FIG. 1 is a side elevational view of an outboard motor constructed in accordance with an embodiment of the invention, as attached to the transom of an associated watercraft, shown partially in cross section.

Referring first to FIG. 1, an outboard motor having an internal combustion engine constructed in accordance with an embodiment of the invention is identified generally by the reference numeral 11. The invention is described in conjunction with an outboard motor because the invention has utility in two cycle internal combustion engines and such engines are normally employed as the power plant in outboard motors. The engine, which is indicated by the reference numeral 12, forms a portion of the power head of the outboard motor 11 and is enclosed by a protective cowling, shown in phantom and identified generally by the reference numeral 13. In the illustrated embodiment, the engine 12 is of the three cylinder in-line type. It is to be understood, however, that the invention may be employed with other cylinder numbers or configurations and those skilled in the art will readily understand how the invention can be employed in conjunction with other cylinder configurations and numbers.

The engine 12, as is typical with outboard motor practice, is disposed so that the cylinders extend horizontally and a crankshaft, indicated by the reference numeral 14, rotates about a vertically extending axis.

A driveshaft housing 15 depends from the afore described power head and rotatably journals a driveshaft 16 that is coupled in a known manner to the crankshaft 14. The driveshaft 16 depends into a lower unit 17 and therein drives a conventional forward/neutral/reverse transmission 18 for driving a propeller shaft 19 and propeller 21 in a well known manner.

A steering shaft 22 is affixed to the driveshaft housing 15 by upper and lower brackets 23 and 24. This steering shaft 22 has a tiller 25 affixed to its upper end and is journaled within a swivel bracket 26 for steering of the outboard motor 11 about a generally vertically extending steering axis, as is well known in this art.

The swivel bracket 26 is connected to a clamping bracket 27 by means of a pivot pin 28 which is generally horizontally disposed so as to allow tilt and trim of the outboard motor 11 as is well known in this art. A clamping device 29 is carried by the clamping bracket 27 for affixing the outboard motor 11 to a transom 31 of an associated watercraft.

The engine 12 is water cooled and, as is typical in outboard motor practice, a water pump 32 is carried within the driveshaft housing 15 at the interface with the lower unit 17. The water pump 32 is driven by the driveshaft 16 in a known manner and supplies cooling water which has been drawn from the body of water in which the outboard motor 11 is operating and delivers it to the engine cooling jacket through a supply conduit 33.

It should be understood that the foregoing description of the outboard motor 11 is purely to illustrate a specific application for the embodiments of the invention and for that reason, further details of the construction of the outboard motor are not necessary to understand and practice the invention.

The invention relates primarily to the scavenging system for the engine 12 and this will now be described initially by particular reference to FIG. 2. In this FIGURE, only a cross section taken through a single cylinder of the engine 12 is depicted as it is believed readily apparent to those skilled in the art how the invention may be practiced in conjunction with multiple cylinder engines.

The engine 12 includes a cylinder block 34 in which three cylinder bores 35 are formed by liners 36 that are cast or pressed into openings in the cylinder block 34.

Pistons 37 reciprocate in each of the cylinder bores 35 and are connected by means of respective connecting rods 38 to the throws 39 of the crankshaft 14. The crankshaft 14 is rotatably journaled within a crankcase chamber 41 that is formed by a skirt 42 of the cylinder block 34 and a crankcase member 43 that is affixed to the cylinder block 34 in any known manner.

A cylinder head assembly 44 is affixed to the cylinder block 34 in a known manner and has recesses 45 which cooperate with the cylinder bores 35 and pistons 37 to form the individual combustion chambers of the engine. As will be hereinafter noted, the recesses 45 are offset to one side of the cylinder bore 35 to improve scavenging. Spark plugs 46 are mounted in the cylinder head 44 and associated with each of the recesses 45 for firing the charge therein. A suitable ignition system (not shown) fires the spark plugs 46.

The engine 12 is provided with a scavenging system which includes a scavenge pump, indicated generally by the reference numeral 47. In the illustrated embodiment, the scavenge pump 47 is of the positive displacement Roots type having a pair of intermeshing rotors 48 that are driven by the crankshaft 14 in a suitable manner. Atmospheric air is drawn into the scavenge pump 47 through an air inlet 49 in which a throttle valve 51 is positioned. The throttle valve 51 is controlled by the operator so as to control the speed of the engine 12 as is well known.

Figure 2:
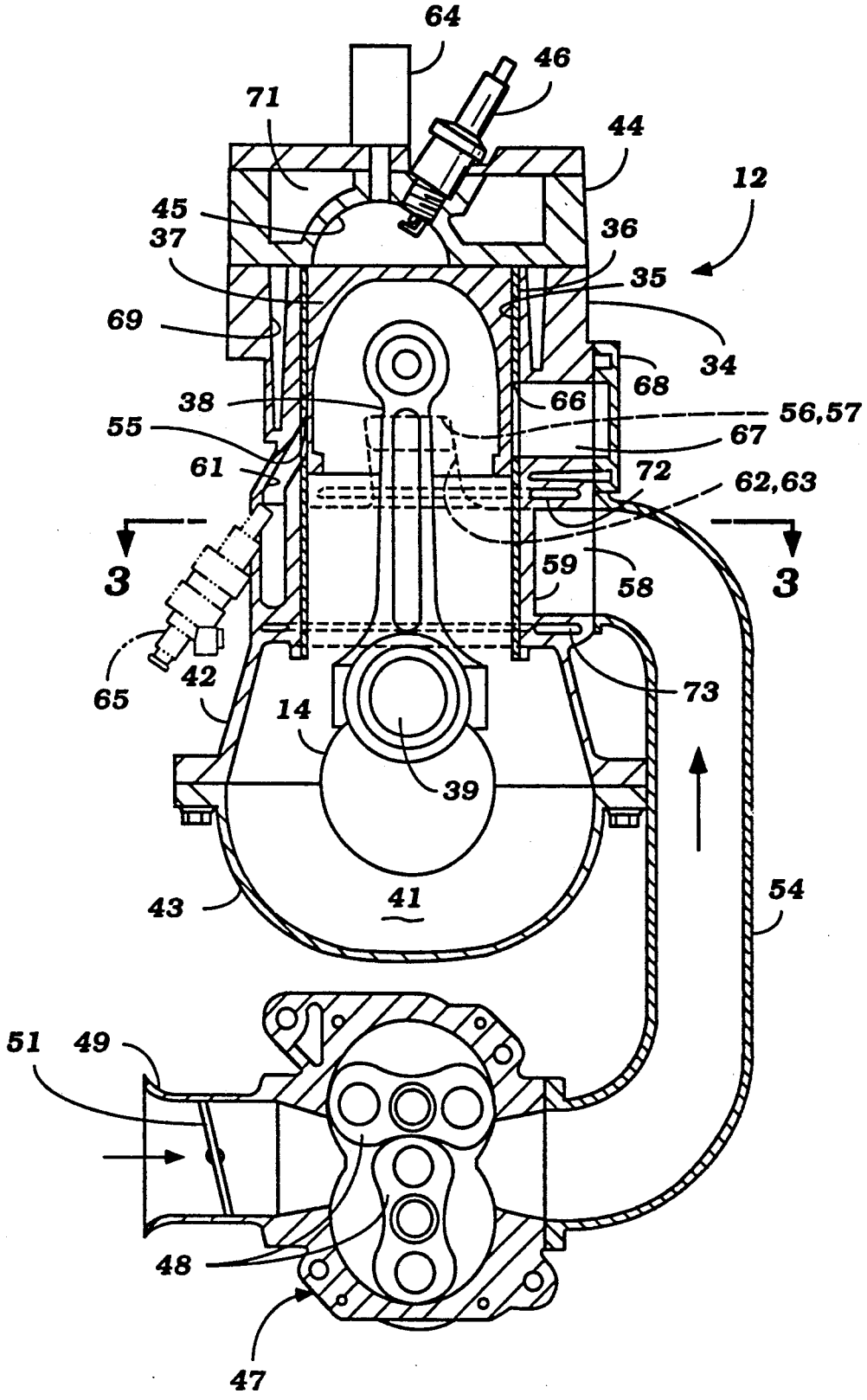
FIG. 2 is an enlarged cross-sectional view taken through a single cylinder of the engine of the outboard motor.
Figure 3:
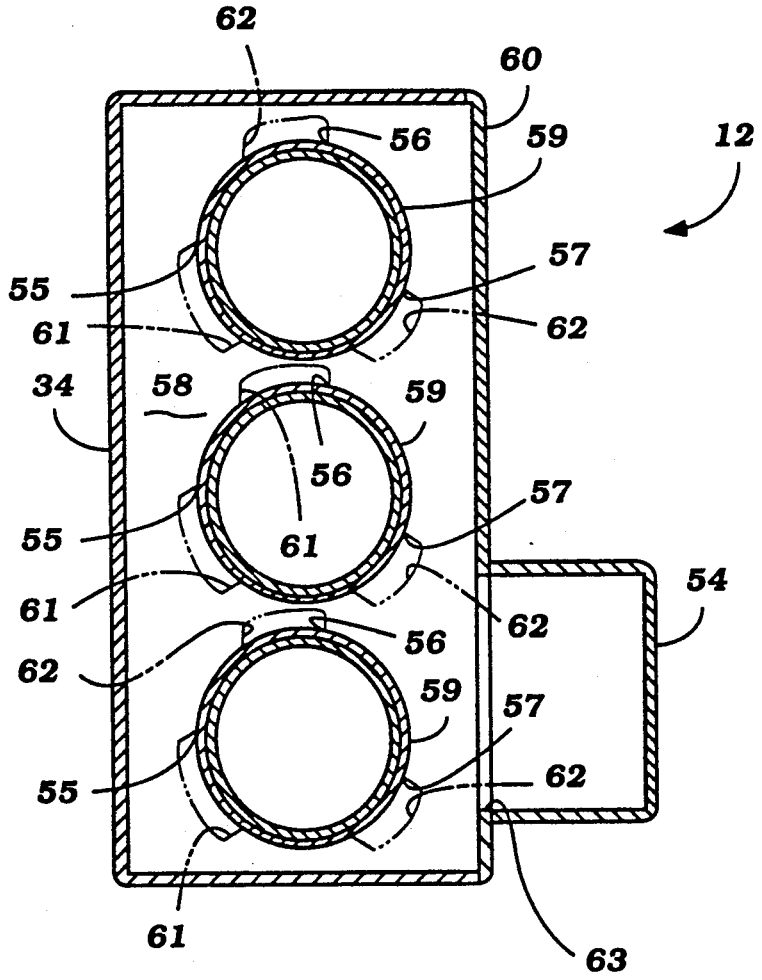
FIG. 3 is a cross-sectional view taken along the line 3—3 of FIG. 2.

The scavenge pump 47 discharges into an intake manifold 54 that cooperates with a scavenge system, to be described, for supplying, in this embodiment, three scavenge ports for each cylinder including a center scavenge port 55 and a pair of side scavenge ports 56 and 57 (see FIG. 3 in addition to FIG. 2). In the past, it has been the practice to supply each of the scavenge ports 55, 56 and 57 from a common scavenge manifold that extended at least partially around each cylinder bore 35 in the cylinder block 34. However, such an arrangement does not provide equal air flow to each of the scavenge ports 55, 56 and 57 or, alternatively, does not permit the desired flow relationships between the scavenge ports 55, 56 and 57 to permit the achievement of the desired scavenging action within the cylinder bore 35. The scavenge manifolds previously employed have been cast within the cylinder block 34 and have been relatively small in configuration.

In accordance with the invention, the disadvantages of the prior art type of constructions are avoided by providing a very substantial plenum chamber 58 which is formed in the lower end of the cylinder block 34 above the skirt portion 42 and which leaves a relatively small cylinder portion 59 of the cylinder block 42 around each cylinder liner 36 which supports the lower ends of the cylinder liners. As a result of this and as may be readily seen in FIG. 3, this provides a substantial volume around each cylinder so as to provide a very substantial plenum volume. A center riser section 61 extends from the plenum chamber 58 to the center intake port 55 of each cylinder bore 35. In addition, a pair of side risers 62 and 63 extend from the plenum chamber 58 to the side intake ports 56 and 57. As a result of this construction, there is such a substantial plenum area serving each of the scavenge ports 55, 56 and 57 that there will be no reduction in air flow to any of the scavenge ports because of the fact that other scavenge ports are supplied. Hence, the disadvantages of the prior art type of constructions are avoided.

As may be seen in FIG. 3, an opening 63 is formed in the side of the cylinder block 34 which communicates the intake manifold 54 with the plenum chamber 58. The side of the cylinder block 34 may be generally open to facilitate casting of the block 34 and plenum chamber 58 and closed by a cover plate 60 to which the manifold 54 is fixed.

An air/fuel injector 64 is supported in the cylinder head assembly 44 for each cylinder bore 35 and sprays the fuel directly into the combustion chambers formed by the recesses 45. Alternatively, electronically controlled fuel injector 65 shown in phantom in FIG. 2, may be provided for spraying the fuel into the combustion chambers through the center scavenge port 55. In such an arrangement, the fuel injectors 65 inject into the risers 61.

An exhaust port 66 is formed on the side of each cylinder liner 36 in opposing relationship to the center scavenge port 55. The exhaust port 66 communicates with an exhaust manifold 67 formed in the cylinder block 34 above the scavenge plenum chamber 58 and discharges the exhaust gases downwardly through an exhaust system (not shown) contained within the driveshaft housing 15 and lower unit 17, as is typical with outboard motor practice. A cover plate 68 encloses the outer portion of the exhaust manifold 67 and is affixed to the cylinder block 34 in any suitable manner.

As has been previously noted, the engine 12 is also water cooled and has a cylinder block cooling jacket 69 and a cylinder head cooling jacket 71 through which water is circulated by the water pump 32. In addition, upper and lower water jackets 72 and 73 are formed in the lower portion of the cylinder block 34 above and below the plenum chamber 58 so as to assist in maintaining a low temperature of the intake charge and high volumetric efficiency.

It should be readily apparent from the foregoing description that the described embodiment of the invention is very effective in providing adequate air flow to all scavenge ports of the engine and thus can permit the desired scavenge pattern within the cylinder bores. Of course, the foregoing description is that of a preferred embodiment of the invention and various changes and modifications may be made without departing from the spirit and scope of the invention, as defined by the appended claims.

We claim:

1. An internal combustion engine comprised of a cylinder block forming at least one cylinder and cylinder bore, said cylinder block being formed with an internal plenum chamber surrounding said cylinder, at least a pair of scavenge ports extending through said cylinder for admitting a charge thereto, at least a pair of scavenge riser passages communicating said plenum chamber with respective of said scavenge ports, said plenum chamber having a substantially greater dimension radially of said cylinder bore than said scavenge riser passages for supplying an unrestricted flow to said scavenge riser passages, and an inlet opening entering into said plenum chamber and having a width greater than the diameter of said cylinder bore.

2. An internal combustion engine as set forth in claim 1 wherein the cylinder block is provided with a plurality of cylinders and cylinder bores and wherein the internal plenum chamber surrounds all of these cylinders.

3. An internal combustion engine as set forth in claim 2 wherein the cylinder block defines the plenum chamber by means of a plurality of cylinder portions defining the lower ends of the cylinder bores and an outer wall.

4. An internal combustion engine as set forth in claim 3 wherein the outer wall is spaced outwardly from the lower cylinder portions to define a substantial volume for the plenum chamber.

5. An internal combustion engine as set forth in claim 4 further including compressor means for supplying a compressed air charge to the plenum chamber.

6. An internal combustion engine as set forth in claim 1 wherein the cylinder block is water cooled and is formed with cooling jacket portions above and below the plenum chamber.

7. An internal combustion engine as set forth in claim 6 wherein the cylinder block is provided with a plurality of cylinders and cylinder bores and wherein the internal plenum chamber surrounds all of these cylinders.

8. An internal combustion engine as set forth in claim 7 wherein the cylinder block defines the plenum chamber by means of a plurality of cylinder portions defining the lower ends of the cylinder bores and an outer wall.

9. An internal combustion engine as set forth in claim 8 wherein the outer wall is spaced outwardly from the lower cylinder portions to define a substantial volume for the plenum chamber.

10. An internal combustion engine as set forth in claim 9 further including compressor means for supplying a compressed air charge to the plenum chamber.

11. An internal combustion engine as set forth in claim 4 wherein the outer wall has an opening extending through one side of the cylinder block and wherein the opening is closed by a removable cover plate.

12. An internal combustion engine as set forth in claim 11 further including an intake manifold for supplying air to the plenum chamber through the removable cover plate.

13. An internal combustion engine as set forth in claim 12 further including compressor means for supplying a compressed air charge to the plenum chamber.

14. An internal combustion engine as set forth in claim 9 wherein the outer wall has an opening extending through one side of the cylinder block and wherein the opening is closed by a removable cover plate.

15. An internal combustion engine as set forth in claim 14 further including an intake manifold for supplying air to the plenum chamber through the removable cover plate.

16. An internal combustion engine as set forth in claim 15 further including compressor means for supplying a compressed air charge to the plenum chamber.

* * * * *